US010590504B2

(12) United States Patent
Takashima et al.

(10) Patent No.: US 10,590,504 B2
(45) **Date of Patent: *Mar. 17, 2020**

(54) HIGH-STRENGTH COLD-ROLLED STEEL SHEET AND METHOD FOR MANUFACTURING THE SAME

(71) Applicant: JFE STEEL CORPORATION, Tokyo (JP)

(72) Inventors: Katsutoshi Takashima, Chiba (JP); Kohei Hasegawa, Tokyo (JP); Yoshimasa Funakawa, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 255 days.

This patent is subject to a terminal disclaimer.

(21) Appl. No.: 15/535,175

(22) PCT Filed: Oct. 27, 2015

(86) PCT No.: PCT/JP2015/005376

§ 371 (c)(1),
(2) Date: Jun. 12, 2017

(87) PCT Pub. No.: WO2016/092733

PCT Pub. Date: Jun. 16, 2016

(65) Prior Publication Data

US 2017/0321297 A1 Nov. 9, 2017

(30) Foreign Application Priority Data

Dec. 12, 2014 (JP) ..... 2014-251449

(51) Int. Cl.
*C21D 9/46* (2006.01)
*C22C 38/14* (2006.01)
(Continued)

(52) U.S. Cl.
CPC ..... *C21D 9/46* (2013.01); *C21D 1/28* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0247* (2013.01); *C21D 8/0263* (2013.01); *C21D 8/0273* (2013.01); *C21D 8/0405* (2013.01); *C21D 8/0426* (2013.01); *C21D 8/0436* (2013.01); *C21D 8/0447* (2013.01); *C21D 8/0463* (2013.01); *C21D 8/0473* (2013.01); *C21D 9/48* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/28* (2013.01); *C22C 38/32* (2013.01); *C22C 38/38* (2013.01); *C22C 38/58* (2013.01);
(Continued)

(58) Field of Classification Search
CPC ..... C21D 1/28; C21D 2211/002; C21D 2211/008; C21D 6/001; C21D 6/002; C21D 6/005; C21D 6/008; C21D 8/0205; C21D 8/0226; C21D 8/0236; C21D 8/0247; C21D 8/0263; C21D 8/0273; C21D 8/0278; C21D 8/0405; C21D 8/0426; C21D 8/0436; C21D 8/0447; C21D 8/0463; C21D 8/0473; C21D 8/0478; C21D 9/46; C21D 9/48; C22C 38/00; C22C 38/001; C22C 38/002; C22C 38/005; C22C 38/02; C22C 38/04; C22C 38/06; C22C 38/08; C22C 38/12; C22C 38/14; C22C 38/16; C22C 38/18; C22C 38/28; C22C 38/32; C22C 38/38; C22C 38/58
See application file for complete search history.

(56) References Cited

U.S. PATENT DOCUMENTS 6,423,426 B1 * 7/2002 Kobayashi ..... C21D 1/185 148/320
2013/0087257 A1 4/2013 Yoshino et al.
(Continued)

FOREIGN PATENT DOCUMENTS

CN 103476960 A 12/2013
EP 2 508 640 A1 10/2012
(Continued)

OTHER PUBLICATIONS

Sep. 13, 2018 Office Action issued in U.S. Appl. No. 15/129,938.
(Continued)

*Primary Examiner* — Jenny R Wu
(74) *Attorney, Agent, or Firm* — Oliff PLC

(57) ABSTRACT

A high-strength cold-rolled steel sheet having a specified chemical composition and a microstructure including ferrite having an average crystal grain diameter of 2 μm or less in an amount of 10% to 25% in terms of volume fraction, retained austenite in an amount of 5% to 20% in terms of volume fraction, martensite having an average crystal grain diameter of 2 μm or less in an amount of 5% to 15% in terms of volume fraction, and the balance being a multi-phase structure including bainite and tempered martensite having an average crystal grain diameter of 5 μm or less, in which a relational expression, $0.35 \leq V2/V1 \leq 0.75$ (1), is satisfied, where V1 is a volume fraction of phases which are different from ferrite and V2 is a volume fraction of tempered martensite.

8 Claims, No Drawings

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/58*** | (2006.01) |
| ***C21D 8/04*** | (2006.01) |
| ***C21D 1/28*** | (2006.01) |
| ***C22C 38/18*** | (2006.01) |
| ***C21D 9/48*** | (2006.01) |
| ***C21D 6/00*** | (2006.01) |
| ***C22C 38/08*** | (2006.01) |
| ***C22C 38/12*** | (2006.01) |
| ***C22C 38/16*** | (2006.01) |
| ***C22C 38/28*** | (2006.01) |
| ***C22C 38/32*** | (2006.01) |
| ***C22C 38/38*** | (2006.01) |

(52) U.S. Cl.

CPC ..... *C21D 6/001* (2013.01); *C21D 6/002* (2013.01); *C21D 8/0278* (2013.01); *C21D 8/0478* (2013.01); *C21D 2211/002* (2013.01); *C21D 2211/008* (2013.01)

(56) References Cited

U.S. PATENT DOCUMENTS

| | | | | |
|---|---|---|---|---|
| 2013/0133792 | A1* | 5/2013 | Nakagaito ..... | C21D 1/25 148/645 |
| 2014/0000765 | A1 | 1/2014 | Nozaki et al. | |
| 2014/0234660 | A1 | 8/2014 | Kawata et al. | |
| 2014/0238557 | A1 | 8/2014 | Haga et al. | |
| 2014/0322559 | A1 | 10/2014 | Becker et al. | |
| 2014/0342184 | A1 | 11/2014 | Takagi et al. | |
| 2015/0299834 | A1 | 10/2015 | Mizuta et al. | |
| 2016/0177414 | A1 | 6/2016 | Takashima et al. | |
| 2016/0177427 | A1 | 6/2016 | Takashima et al. | |
| 2017/0022582 | A1 | 1/2017 | Takashima et al. | |
| 2017/0107591 | A1 | 4/2017 | Takashima et al. | |
| 2017/0321297 | A1 | 11/2017 | Takashima et al. | |

FOREIGN PATENT DOCUMENTS

| | | | | |
|---|---|---|---|---|
| EP | 2 692 893 | A1 | | 2/2014 |
| EP | 2 740 812 | A1 | | 6/2014 |
| EP | 2 762 582 | A1 | | 8/2014 |
| EP | 3 012 339 | A1 | | 4/2016 |
| EP | 3 128 027 | A1 | | 2/2017 |
| JP | 2009-263685 | A | | 11/2009 |
| JP | 4411221 | B2 | | 2/2010 |
| JP | 2010-059452 | A | | 3/2010 |
| JP | 2011-52295 | A | | 3/2011 |
| JP | 4712838 | B2 | | 6/2011 |
| JP | 2011144404 | A | | 7/2011 |
| JP | 2011144404 | A | * | 7/2011 |
| JP | 4868771 | B2 | | 2/2012 |
| JP | 2012-229466 | A | | 11/2012 |
| JP | 2013-14823 | A | | 1/2013 |
| JP | 2014-080665 | A | | 5/2014 |
| JP | 2014-133944 | A | | 7/2014 |
| KR | 2012-0062933 | A | | 6/2012 |
| KR | 2014-0041838 | A | | 4/2014 |
| KR | 2014-0052072 | A | | 5/2014 |

OTHER PUBLICATIONS

Jan. 29, 2019 Office Action issued in U.S. Appl. No. 15/129,938.

Aug. 7, 2018 Office Action issued in European Patent Application No. 15867575.1.

Aug. 22, 2018 Office Action issued in Korean Patent Application No. 2017-7015003.

Sep. 13, 2017 Search Report issued in European Patent Application No. 15867575.1.

Jan. 12, 2016 Search Report issued in International Patent Application No. PCT/JP2015/005376.

Jan. 25, 2018 Office Action issued in Chinese Patent Application No. 201580066892.8.

Jun. 5, 2018 Office Action issued in U.S. Appl. No. 14/911,088.

Jan. 12, 2018 Office Action issued in U.S. Appl. No. 14/911,088.

Feb. 22, 2019 Office Action issued in Korean Patent Application No. 2017-7015003.

* cited by examiner

HIGH-STRENGTH COLD-ROLLED STEEL SHEET AND METHOD FOR MANUFACTURING THE SAME

TECHNICAL FIELD

This application relates to a high-strength cold-rolled steel sheet and a method for manufacturing the steel sheet. In particular, a high-strength cold-rolled steel sheet having a tensile strength (TS) of 1180 MPa or more according to the disclosed embodiments can preferably be used as a material for the structural member of, for example, an automobile.

Here, in the present description, the term "yield ratio (YR)" refers to the ratio of yield stress (YS) to tensile strength (TS) and is expressed as YR=YS/TS.

BACKGROUND

Nowadays, since $CO_2$ emission regulations are being strengthened in response to increasing concern about environmental problems, weight reduction of an automobile body for increasing fuel efficiency is an issue to be addressed in order to reduce $CO_2$ emission in the automobile industry. In order to solve this issue, there is a growing trend toward reducing the thickness of a high-strength steel sheet used for automobile parts. For example, there is a growing trend toward using a steel sheet having reduced thickness and a TS of 1180 MPa or more.

Here, a high-strength steel sheet which is used for the structural members and reinforcing members of an automobile is required to have excellent formability. In particular, when parts having a complex shape are formed, such a steel sheet is required to be excellent not in terms of a single property such as elongation or hole expansion capability but in terms of plural properties. Moreover, a high-strength steel sheet which is used for automobile parts such as structural members and reinforcing members is required to be excellent in terms of collision-energy-absorbing capability. Increasing yield ratio is effective for increasing collision-energy-absorbing capability, and, by increasing yield ratio, it is possible to efficiently absorb collision energy with a small amount of deformation. Here, the term "yield ratio (YR)" refers to the ratio of yield stress (YS) to tensile strength (TS) and is expressed as YR=YS/TS.

In addition, in the case of a steel sheet having a tensile strength of 1180 MPa or more, there may be a problem in that delayed fracturing (hydrogen embrittlement) occurs due to hydrogen entering from a usage environment. Therefore, a steel sheet having a tensile strength of 1180 MPa or more is required to be excellent in terms of press formability and delayed fracturing resistance.

Conventionally, a dual-phase steel (DP steel) sheet including a ferrite-martensite structure is known as a high-strength steel sheet having both excellent formability and high strength. For example, Patent Literature 1 discloses a technique in which the balance between elongation and stretch flange formability is increased by controlling the distribution state of cementite grains in tempered martensite. In addition, Patent Literature 2 discloses, as a steel sheet excellent in terms of formability and delayed fracturing resistance, a steel sheet in which the distribution state of precipitates in tempered martensite is controlled.

In addition, examples of a steel sheet having both high strength and excellent ductility include a TRIP steel sheet including retained austenite. In the case where such a TRIP steel sheet is subjected to deformation due to forming work at a temperature equal to or higher than the temperature at which martensite transformation starts, it is possible to achieve large elongation due to the transformation of retained austenite into martensite induced by stress.

However, in the case of such a TRIP steel sheet, since the transformation of retained austenite into martensite occurs when punching work is performed, a crack occurs at an interface with ferrite, which results in a disadvantage in that the steel sheet is poor in terms of hole expansion capability.

Therefore, Patent Literature 3 discloses a TRIP steel sheet having increased elongation and stretch flange formability as a result of including, in terms of area ratio, 60% or more of bainitic ferrite and 20% or less of polygonal ferrite. In addition, Patent Literature 4 discloses a TRIP steel sheet excellent in terms of hydrogen embrittlement resistance as a result of controlling the volume fractions of ferrite, bainitic ferrite, and martensite.

CITATION LIST

Patent Literature

PTL 1: Japanese Unexamined Patent Application Publication No. 2011-52295

PTL 2: Japanese Patent No. 4712838

PTL 3: Japanese Patent No. 4411221

PTL 4: Japanese Patent No. 4868771

SUMMARY

Technical Problem

However, generally, in the case of DP steel, since there is a decrease in yield ratio because movable dislocations are introduced in ferrite when martensite transformation occurs, there is a decrease in collision-energy-absorbing capability. In the case of Patent Literature 1, although there is an increase in hole expansion capability by increasing a tempering temperature, elongation is too small with relation to strength. Also, since the steel sheet according to Patent Literature 2 has an elongation which is too small with relation to strength, the steel sheet is poor in terms of formability.

Also, in the case of a steel sheet utilizing retained austenite, the steel sheet according to Patent Literature 3 has low collision-energy-absorbing capability due to low YR and does not have a high tensile strength of 1180 MPa or more even though the steel sheet has increased elongation and hole expansion capability. Since the steel sheet according to Patent Literature 4 has an elongation which is too small with relation to strength, the steel sheet is poor in terms formability.

As described above, it is difficult to obtain a steel sheet having elongation and hole expansion capability, which are enough to provide excellent press formability, and excellent delayed fracturing resistance while maintaining excellent collision-energy-absorbing capability even in the case of a high tensile strength of 1180 MPa or more. It is a fact that a steel sheet having these good properties (yield ratio, strength, elongation, hole expansion capability, and delayed fracturing resistance) at the same time has not yet been developed to date.

The disclosed embodiments have been completed in order to solve the problems described above, and an object of the disclosed embodiments is, by solving the problems with the conventional techniques, to provide a high-strength cold-rolled steel sheet having the above-described good properties (yield ratio, strength, elongation, hole expansion capability, and delayed fracturing resistance) at the same time and a method for manufacturing the steel sheet.

Solution to Problem

The present inventors diligently conducted investigations in order to solve the problems described above, and, as a result, found that, in order to increase elongation, hole expansion capability, and delayed fracturing resistance while maintaining high yield ratio even in the case of a high tensile strength of 1180 MPa or more, the volume fractions of ferrite, retained austenite, martensite, bainite, and tempered martensite in a microstructure should be controlled while the grain diameter of the microstructure is decreased. Specifically, the disclosed embodiments are based on the knowledge described below.

In the case where martensite or retained austenite having a high hardness exists in a microstructure, voids are formed at its interface, in particular, at the interface between soft ferrite and such a phase during a punching process of a hole expansion test. In the case where voids are formed, the voids combine with each other and grow in a subsequent hole expansion process, which results in a crack occurring. On the other hand, there is an increase in elongation because soft ferrite and retained austenite are included in the microstructure. In addition, in the case where prior γ grain boundaries exist in a microstructure, when hydrogen enters a steel sheet, since hydrogen is trapped at prior γ grain boundaries, there is a significant decrease in the strength of grain boundaries, which results in a decrease in delayed fracturing resistance due to an increase in crack growth rate after the crack has occurred. In addition, regarding yield ratio, although there is an increase in yield ratio due to bainite and tempered martensite having a high dislocation density being included in a microstructure, there is only a small effect on elongation.

Therefore, the present inventors diligently conducted investigations, and, as a result, found that, by controlling the volume fractions of soft phases, from which voids originate, and hard phases, by forming a hard intermediate phase such as tempered martensite or bainite, and by decreasing a crystal grain diameter, it is possible to achieve sufficient strength and hole expansion capability even in the case where some amount of soft ferrite is included. The present inventors, moreover, found that, as a result of tempered martensite, which is effective for increasing delayed fracturing resistance, being included as a hard phase, there is an improvement in the balance between strength and delayed fracturing resistance.

In particular, in order to inhibiting an increase in crystal grain diameter, which occurs in the case where annealing is performed in a temperature range in which an austenite single phase is formed, annealing is performed at an annealing temperature in a dual-phase temperature range in which ferrite can be included. It was clarified that, by optimizing heating rate to an annealing temperature in order to further decrease crystal grain diameter, there is an increase in hole expansion capability and delayed fracturing resistance due to the effect of a decrease in crystal grain diameter.

That is, the disclosed embodiments provide items [1] through [4] below.

[1] A high-strength cold-rolled steel sheet having a chemical composition containing, by mass %, C: 0.15% to 0.25%, Si: 1.2% to 2.5%, Mn: 2.1% to 3.5%, P: 0.05% or less, S: 0.005% or less, Al: 0.01% to 0.08%, N: 0.010% or less, Ti: 0.002% to 0.050%, B: 0.0002% to 0.0100%, and the balance being Fe and inevitable impurities, and a microstructure including ferrite having an average crystal grain diameter of 2 μm or less in an amount of 10% to 25% in terms of volume fraction, retained austenite in an amount of 5% to 20% in terms of volume fraction, martensite having an average crystal grain diameter of 2 μm or less in an amount of 5% to 15% in terms of volume fraction, and the balance being a multi-phase structure including bainite and tempered martensite having an average crystal grain diameter of 5 μm or less, in which relational expression (1) below which indicates the relationship between the volume fraction (V1) of hard phases which are different from ferrite and the volume fraction (V2) of tempered martensite is satisfied.

$$0.35 \leq V2/V1 \leq 0.75 \quad \text{relational expression (1)}$$

[2] The high-strength cold-rolled steel sheet according to item [1], the steel sheet having the chemical composition further containing, by mass %, one or both selected from V: 0.05% or less and Nb: 0.05% or less.

[3] The high-strength cold-rolled steel sheet according to item [1] or [2], the steel sheet having the chemical composition further containing, by mass %, one or more selected from Cr: 0.50% or less, Mo: 0.50% or less, Cu: 0.50% or less, Ni: 0.50% or less, Ca: 0.0050% or less, and REM: 0.0050% or less.

[4] A method for manufacturing a high-strength cold-rolled steel sheet, the method including a hot rolling process in which a rolling operation is performed on a steel slab having the chemical composition according to any one of items [1] to [3] and a temperature of 1150° C. to 1300° C. under the condition of a finishing delivery temperature of 850° C. to 950° C., in which cooling is started within 1 second after the rolling operation, in which a first cooling operation is performed under the conditions of a first average cooling rate of 80° C./s or more and a first cooling stop temperature of 650° C. or lower, in which a second cooling operation is performed after the first cooling operation under the conditions of a second average cooling rate of 5° C./s or more and a second cooling stop temperature of lower than the first cooling stop temperature and 550° C. or lower, and in which a coiling operation is performed after the second cooling operation, a pickling process in which a pickling operation is performed after the hot rolling process as needed, a cold rolling process in which a cold rolling operation is performed after the hot rolling process (or after the pickling process in the case where the pickling process is performed), and an annealing process in which a first heating operation is performed after the cold rolling process at an arbitrary first average heating rate under the condition of a first heating end-point temperature of 250° C. to 350° C., in which a second heating operation is performed after the first heating operation under the conditions of a second average heating rate of 6° C./s to 25° C./s and a second heating end-point temperature of 550° C. to 680° C., in which a third heating operation is performed after the second heating operation under the conditions of a third average heating rate of 10° C./s or less and a third heating end-point temperature of 760° C. to 850° C., in which a first soaking operation is performed after the third heating operation under the conditions of a first soaking temperature of 760° C. to 850° C. and a first soaking time of 30 seconds or more, in which a third cooling operation is performed after the first soaking operation under the conditions of a third average cooling rate of 3° C./s or more and a third cooling stop temperature of 100° C. to 300° C., in which a fourth heating operation is performed after the third cooling operation under the condition of a fourth heating end-point temperature of 350° C. to 450° C., in which a second soaking operation is performed after the fourth heating operation under the conditions of a second soaking temperature of 350° C. to 450° C. and a second soaking time of 30 seconds or more, and in which a fourth cooling operation is performed after the second soaking operation under the condition of a fourth cooling stop temperature of 0° C. to 50° C.

Advantageous Effects

According to the disclosed embodiments, the high-strength cold-rolled steel sheet has very high tensile strength, excellent workability based on high elongation and hole expansion capability, and a high yield ratio. In addition, the high-strength cold-rolled steel sheet according to the disclosed embodiments has excellent delayed fracturing resistance so that delayed fracturing, which is caused by hydrogen entering from an environment, is less likely to occur even after the steel sheet has been formed into a member.

For example, it is possible to stably obtain a high-strength cold-rolled steel sheet excellent in terms of elongation, hole expansion capability, and delayed fracturing resistance which has a tensile strength of 1180 MPa or more, a yield ratio of 70% or more, an elongation of 17.5% or more, and a hole expansion ratio of 40% or more and which may be immersed in hydrochloric acid having a temperature of 20° C. and a pH of 1 for 100 hours while being subjected to stress without the occurrence of fracturing.

DETAILED DESCRIPTION

Hereafter, the disclosed embodiments will be described. Here, the disclosed embodiments are not limited to the embodiments described below. Hereinafter, "%" used when describing a chemical composition shall always refer to "mass %".

<High-Strength Cold-Rolled Steel Sheet>

The high-strength cold-rolled steel sheet according to the disclosed embodiments contains, by mass %, C: 0.15% to 0.25%, Si: 1.2% to 2.5%, Mn: 2.1% to 3.5%, P: 0.05% or less, S: 0.005% or less, Al: 0.01% to 0.08%, N: 0.010% or less, Ti: 0.002% to 0.050%, and B: 0.0002% to 0.0100%.

C: 0.15% to 0.25%

C is a chemical element which is effective for increasing the strength of a steel sheet and which contributes to the formation of second phases in the disclosed embodiments such as bainite, tempered martensite, retained austenite, and martensite. Moreover, C increases the hardness of martensite and tempered martensite. In the case where the C content is less than 0.15%, it is difficult to achieve the necessary volume fractions of bainite, tempered martensite, retained austenite, and martensite. It is preferable that the C content be 0.17% or more. On the other hand, in the case where the C content is excessively large, since there is an increase in difference in hardness among ferrite, tempered martensite, and martensite, there is a decrease in hole expansion capability. Therefore, the C content is set to be 0.25% or less, or preferably 0.22% or less.

Si: 1.2% to 2.5%

Si increases hole expansion ratio by decreasing the difference in hardness among soft phases and hard phases as a result of increasing the strength of ferrite through solid solution strengthening. In order to realize such an effect, it is necessary that the Si content be 1.2% or more, or preferably 1.3% or more. However, in the case where the Si content is excessively large, there is a decrease in phosphatability. Therefore, the Si content is set to be 2.5% or less, or preferably 2.2% or less.

Mn: 2.1% to 3.5%

Mn is a chemical element which contributes to an increase in strength through solid solution strengthening and the formation of second phases. In addition, since Mn is a chemical element which stabilizes austenite, Mn is a chemical element which is necessary for controlling the volume fractions of second phases. In order to realize such effects, it is necessary that the Mn content be 2.1% or more. On the other hand, in the case where the Mn content is excessively large, since there is an excessive increase in the volume fraction of martensite, and since there is an excessive increase in the hardness of martensite and tempered martensite, there is a decrease in hole expansion capability. In addition, in the case where the Mn content is excessively large, since there is an increase in the degree of sliding constraint at grain boundaries when hydrogen enters the steel sheet, a crack occurring at grain boundaries tends to grow, which results in a decrease in delayed fracturing resistance. Therefore, the Mn content is set to be 3.5% or less, or preferably 3.0% or less.

P: 0.05% or Less

P contributes to an increase in strength through solid solution strengthening. However, in the case where the P content is excessively large, since the segregation of P becomes significant at grain boundaries, grain boundary embrittlement occurs, and there is a decrease in weldability. Therefore, the P content is set to be 0.05% or less, or preferably 0.04% or less.

S: 0.005% or Less

In the case where the S content is large, since large amounts of sulfides such as MnS are formed, there is a decrease in local elongation typified by hole expansion capability. Therefore, the upper limit of the S content is set to be 0.005%, or preferably 0.0040% or less. Although there is no particular limitation on the lower limit, since there is an increase in steel-making costs in order to control the S content to be very low, it is preferable that the S content be 0.0002% or more.

Al: 0.01% to 0.08%

Al is a chemical element which is necessary for deoxidation, and, in order to realize such an effect, it is necessary that the Al content be 0.01% or more. In addition, since such an effect becomes saturated in the case where the Al content is more than 0.08%, the Al content is set to be 0.08% or less, or preferably 0.05% or less.

N: 0.010% or Less

Since N decreases bendability and stretch flange formability by forming coarse nitrides, it is necessary that the N content be as small as possible. Such problems become significant in the case where the N content is more than 0.010%. Therefore, the N content is set to be 0.010% or less, or preferably 0.0050% or less.

Ti: 0.002% to 0.050%

Ti is a chemical element which is capable of contributing to an increase in strength by forming fine carbonitrides. Moreover, Ti is necessary for preventing B, which is an indispensable chemical element for the disclosed embodiments, from combining with N. In order to realize such effects, it is necessary that the Ti content be 0.002% or more, or preferably 0.005% or more. On the other hand, in the case where the Ti content is large, there is a significant decrease in elongation. Therefore, the Ti content is set to be 0.050% or less, or preferably 0.035% or less.

B: 0.0002% to 0.0100%

B is a chemical element which contributes to an increase in strength by forming second phases as a result of increasing hardenability and which does not lower the temperature at which martensite transformation starts while achieving sufficient hardenability. Moreover, B is effective for inhibiting the formation of ferrite and pearlite when cooling is performed after finish rolling has been performed in a hot rolling process. In order to realize such effects, it is necessary that the B content be 0.0002% or more. On the other hand, in the case where the B content is more than 0.0100%, such effects become saturated. Therefore, the B content is set to be 0.0100% or less, or preferably 0.0050% or less.

The high-strength cold-rolled steel sheet according to the disclosed embodiments may further contain, by mass %, one or both selected from V: 0.05% or less and Nb: 0.05% or less.

V: 0.05% or Less

V contributes to an increase in strength by forming fine V carbonitrides. In order to realize such an effect, it is preferable that the V content be 0.01% or more. On the other hand, in the case where the V content is large, there is only a small increase in effect of increasing strength corresponding to a large amount of increase in V content in the case where the V content is more than 0.05%, and there is an increase in alloy costs. Therefore, it is preferable that the V content be 0.05% or less.

Nb: 0.05% or Less

Since Nb, like V, can contribute to an increase in strength as a result of forming fine carbonitrides, Nb may be added as needed. In order to realize such an effect, it is preferable that the Nb content be 0.005% or more. On the other hand, in the case where the Nb content is large, there is a significant decrease in elongation. Therefore, in the case where Nb is added, the Nb content is set to be 0.05% or less.

In addition, the high-strength cold-rolled steel sheet according to the disclosed embodiments may contain, by mass %, one or more selected from Cr: 0.50% or less, Mo: 0.50% or less, Cu: 0.50% or less, Ni: 0.50% or less, Ca: 0.0050% or less, and REM: 0.0050% or less.

Cr: 0.50% or Less

Since Cr is a chemical element which contributes to an increase in strength by forming second phases, Cr may be added as needed. In order to realize such an effect, it is preferable that the Cr content be 0.10% or more. On the other hand, in the case where the Cr content is more than 0.50%, an excessive amount of martensite is formed. Therefore, in the case where Cr is added, the Cr content is set to be 0.50% or less.

Mo: 0.50% or less

Since Mo is a chemical element which contributes to an increase in strength by forming second phases and by forming some carbides, Mo may be added as needed. In order to realize such an effect, it is preferable that the Mo content be 0.05% or more. In addition, in the case where the Mo content is more than 0.50%, such an effect becomes saturated. Therefore, it is preferable that the Mo content be 0.50% or less.

Cu: 0.50% or Less

Since Cu is a chemical element which contributes to an increase in strength through solid solution strengthening and by forming second phases, Cu may be added as needed. In order to realize such an effect, it is preferable that the Cu content be 0.05% or more. On the other hand, in the case where the Cu content is more than 0.50%, such an effect becomes saturated, and surface defects due to Cu tend to occur. Therefore, it is preferable that the Cu content be 0.50% or less.

Ni: 0.50% or Less

Since Ni is, like Cu, a chemical element which contributes to an increase in strength through solid solution strengthening and by forming second phases, Ni may be added as needed. In order to realize such an effect, it is preferable that the Ni content be 0.05% or more. In addition, there is an effect of inhibiting surface defects due to Cu in the case where Ni is added in combination with Cu, adding Ni when Cu is added is effective. On the other hand, in the case where the Ni content is more than 0.50%, such an effect becomes saturated. Therefore, it is preferable that the Ni content be 0.50% or less.

Ca: 0.0050% or Less

Since Ca is a chemical element which decreases the negative effect of sulfides on hole expansion capability by spheroidizing sulfides, Ca may be added as needed. In order to realize such an effect, it is preferable that the Ca content be 0.0005% or more. On the other hand, in the case where the Ca content is more than 0.0050%, there is a decrease in bendability due to Ca sulfides. Therefore, Ca content is set to be 0.0050% or less.

REM: 0.0050% or Less

Since REM is, like Ca, a chemical element which decreases the negative effect of sulfides on hole expansion capability by spheroidizing sulfides, REM may be added as needed. In order to realize such an effect, it is preferable that the REM content be 0.0005% or more. On the other hand, in the case where the REM content is more than 0.0050%, such an effect becomes saturated. Therefore, it is preferable that the REM content be 0.0050% or less.

The remainder which is different from the chemical elements described above is Fe and inevitable impurities. Examples of the inevitable impurities include Sb, Sn, Zn, and Co. The acceptable contents of such chemical elements are respectively Sb: 0.01% or less, Sn: 0.1% or less, Zn; 0.01% or less, and Co: 0.1% or less. In addition, there is no decrease in the effects of the disclosed embodiments even in the case where Ta, Mg, and Zr are added in amounts within the ranges of the contents of theses chemical elements in the chemical composition of an ordinary steel.

Hereafter, the microstructure of the high-strength cold-rolled steel sheet according to the disclosed embodiments will be described in detail.

The microstructure of the high-strength cold-rolled steel sheet according to the disclosed embodiments includes ferrite, retained austenite, martensite, and the balance being a multi-phase structure including bainite and tempered martensite.

Specifically, the microstructure includes ferrite having an average crystal grain diameter of 2 μm or less in an amount of 10% to 25% in terms of volume fraction, retained austenite in an amount of 5% to 20% in terms of volume fraction, martensite having an average crystal grain diameter of 2 μm or less in an amount of 5% to 15% in terms of volume fraction, and the balance being a multi-phase structure including bainite and tempered martensite having an average crystal grain diameter of 5 μm or less. The relationship between the volume fraction of hard phases (meaning phases other than ferrite) which are different from ferrite and the volume fraction of tempered martensite is expressed by relational expression (1). Hereinafter, the term "volume fraction" shall refer to a volume fraction with respect to the whole volume of a steel sheet. Here, volume fraction and average crystal grain diameter are defined as the corresponding values obtained by using the methods described in EXAMPLES below.

$$0.35 \leq V2/V1 \leq 0.75 \quad \text{relational expression (1)}$$

In relational expression (1), the volume fraction of the hard phases which are different from ferrite is defined as V1, and the volume fraction of tempered martensite is defined as V2.

Ferrite (Ferrite Having an Average Crystal Grain Diameter of 2 μm or Less)

In the case where the volume fraction of ferrite is less than 10%, it is difficult to achieve sufficient elongation. Therefore, the volume fraction of ferrite is set to be 10% or more, or preferably more than 12%. In addition, in the case where the volume fraction of ferrite is more than 25%, there is an increase in the number of voids formed when punching is performed. In addition, in the case where the volume fraction of ferrite is more than 25%, since it is necessary that the hardness of martensite and tempered martensite be increased in order to achieve sufficient strength, it is difficult to achieve sufficient strength and hole expansion capability at the same time. Therefore, the volume fraction of ferrite is set to be 25% or less, preferably 22% or less, or more preferably less than 20%.

In addition, in the case where the average crystal grain diameter of ferrite is more than 2 μm, since voids which are formed in a punched end face when hole expansion is performed tend to combine with each other when hole expansion is performed, it is not possible to achieve good hole expansion capability. Therefore, the average crystal grain diameter of ferrite is set to be 2 μm or less.

Retained Austenite

In order to achieve good ductility, it is necessary that the volume fraction of retained austenite be 5% to 20%. In the case where the volume fraction of retained austenite is less than 5%, there is a decrease in elongation. Therefore, the volume fraction of retained austenite is set to be 5% or more, or preferably 8% or more. In addition, in the case where the volume fraction of retained austenite is more than 20%, there is a decrease in hole expansion capability. Therefore, the volume fraction of retained austenite is set to be 20% or less, or preferably 18% or less.

Martensite (Martensite Having an Average Crystal Grain Diameter of 2 μm or Less)

In order to achieve sufficient hole expansion capability while achieving the desired strength and ductility, the volume fraction of martensite is set to be 5% to 15%. In the case where the volume fraction of martensite is less than 5%, since there is a decrease in contribution to work hardening, it is difficult to achieve sufficient strength and ductility at the same time. It is preferable that the volume fraction of martensite be 6% or more. In addition, in the case where the volume fraction of martensite is more than 15%, there is a decrease in hole expansion capability due to voids being formed around martensite when punching is performed, and there is a decrease in yield ratio. Therefore, the upper limit of the volume fraction of martensite is set to be 15%, or preferably 12%.

In addition, in the disclosed embodiments, the average crystal grain diameter of martensite is set to be 2 μm or less. In the case where the average crystal grain diameter of martensite is more than 2 μm, since voids which are formed at the interface with ferrite tend to combine with each other, there is a decrease in hole expansion capability. Therefore, the upper limit of the average crystal grain diameter of martensite is set to be 2 μm. Here, the term "martensite" refers to martensite which is formed when austenite, which is left untransformed after having been held in a temperature range of 350° C. to 450° C., that is, the second soaking temperature range in the continuous annealing process, is cooled to room temperature.

Remainder

In order to achieve good hole expansion capability and a high yield ratio, it is necessary that the remainder which is different from ferrite, retained austenite, and martensite described above include bainite and tempered martensite. The average crystal grain diameter of bainite and tempered martensite is set to be 5 μm or less. In the case where the average crystal grain diameter is more than 5 μm, since voids which are formed at the interface with ferrite tend to combine each other, there is a decrease in hole expansion capability. Therefore, the upper limit of the average crystal grain diameter of bainite and tempered martensite is set to be 5 μm.

In addition, it is preferable that the volume fraction of bainite be 10% to 40% and that the volume fraction of tempered martensite be 20% to 60%. Here, the term "the volume fraction of bainite" refers to the volume fraction of bainitic ferrite (ferrite having a high dislocation density) with respect to the observed surface. In addition, the term "tempered martensite" refers to martensite which is formed from a part of untransformed austenite through martensite transformation in the cooling operation (the third cooling operation described below) to a temperature of 100° C. to 300° C. in the annealing process, which is then heated to a temperature of 350° C. to 450° C., and which is then tempered when the holding operation (the second soaking operation) is performed in the annealing process.

$$0.35 \leq V2/V1 \leq 0.75$$

In addition, it is necessary that the volume fraction (V1) of hard phases which are different from a ferrite phase and the volume fraction (V2) of tempered martensite satisfy the relationship expressed by relational expression (1). The martensite which has been formed in the cooling operation is made into tempered martensite by tempering the martensite in the reheating operation and the subsequent soaking operation. Due to the existence of such tempered martensite, since bainite transformation is promoted in the soaking operation, there is a decrease in the crystal grain diameter of the martensite which is formed finally when cooling is performed to room temperature, and it is possible to control the volume fraction of martensite to be the target volume fraction. In the case where the value of V2/V1 in relational expression (1) is less than 0.35, such effects are small. Therefore, the lower limit of V2/V1 is set to be 0.35. In addition, in the case where the value of V2/V1 is more than 0.75, since there is an insufficient amount of untransformed austenite, which is capable of undergoing bainite transformation, there is an insufficient amount of retained austenite, which results in a decrease in elongation. Therefore, the upper limit of V2/V1 is set to be 0.75, or preferably 0.70 or less.

$$0.35 \leq V2/V1 \leq 0.75 \quad \text{relational expression (1)}$$

In addition, in the disclosed embodiments, there is a case where the microstructure includes pearlite besides ferrite, bainite, tempered martensite, retained austenite, and martensite. The object of the disclosed embodiments is achieved even in the case where pearlite is included as long as the above-described conditions regarding the volume fractions of ferrite, retained austenite, and martensite and the average crystal grain diameter of ferrite and martensite are satisfied. However, it is preferable that the volume fraction of pearlite be 3% or less.

<Method for Manufacturing High-Strength Cold-Rolled Steel Sheet>

Hereafter, the method for manufacturing a high-strength cold-rolled steel sheet according to the disclosed embodiments will be described.

The method for manufacturing a high-strength cold-rolled steel sheet according to the disclosed embodiments includes a hot rolling process, a pickling process, a cold rolling process, and an annealing process. Hereafter, each process will be described. Hereinafter, an average cooling rate is calculated by equation (2), and an average heating rate is calculated by equation (3).

$$\text{average cooling rate}=(\text{cooling start surface temperature}-\text{cooling stop surface temperature})/\text{cooling time} \quad (2)$$

$$\text{average heating rate}=(\text{heating stop surface temperature}-\text{heating start surface temperature})/\text{heating time} \quad (3)$$

Hot Rolling Process

The hot rolling process is a process in which a rolling operation is performed on a steel slab having the chemical composition described above and a temperature of 1150° C. to 1300° C. under the condition of a finishing delivery temperature of 850° C. to 950° C., in which cooling is started within 1 second after the rolling operation, in which a first cooling operation is performed under the conditions of a first average cooling rate of 80° C./s or more and a first cooling stop temperature of 650° C. or lower, in which a second cooling operation is performed after the first cooling operation under the conditions of a second average cooling rate of 5° C./s or more and a second cooling stop temperature of lower than the first cooling stop temperature and 550° C. or lower, and in which a coiling operation is performed after the second cooling operation. The reasons for the limitations on the conditions will be described hereafter.

The hot rolling start temperature (corresponding to the temperature of the steel slab to be rolled) is set to be 1150° C. to 1300° C. Hot rolling may be started without reheating the steel slab after casting has been performed at a temperature of 1150° C. to 1300° C. or after having reheated the steel slab to a temperature of 1150° C. to 1300° C. That is, in the disclosed embodiments, besides a conventional method, in which a manufactured steel slab is first cooled to room temperature and then reheated, a method using an energy-saving process such as a hot direct rolling process, in which a manufactured steel slab in the hot slab state is charged into a heating furnace without being cooled, and in which the heated slab is then subjected to hot rolling, or a direct rolling process, in which a manufactured steel slab is directly subjected to hot rolling in the cast state, may be used without causing any problem. Here, although it is preferable that a steel slab is manufactured by using a continuous casting method in order to prevent the macro segregation of constituent chemical elements, a steel slab may be manufactured by using an ingot-making method or a thin-slab casting method.

In the case where the hot rolling start temperature described above is lower than 1150° C., there is a decrease in productivity due to an increase in rolling load. In the case where the hot rolling start temperature is higher than 1300° C., there is only an increase in heating costs. Therefore, the hot rolling start temperature is set to be 1150° C. to 1300° C.

The finishing delivery temperature is set to be 850° C. to 950° C. It is necessary that hot rolling be finished in a temperature range in which an austenite single phase is formed in order to increase elongation and hole expansion capability after annealing has been performed by homogenizing a microstructure in a steel sheet and by decreasing the material anisotropy of the steel sheet. Therefore, the finishing delivery temperature is set to be 850° C. or higher. On the other hand, in the case where the finishing delivery temperature is higher than 950° C., since there is an increase in the crystal grain diameter of the hot-rolled microstructure, there is a deterioration in properties after annealing has been performed. Therefore, the finishing delivery temperature is set to be 850° C. to 950° C.

The first cooling operation following finish rolling is a cooling operation in which cooling is started within 1 second after the hot rolling operation described above and in which cooling is performed under the conditions of a first average cooling rate of 80° C./s or more and a first cooling stop temperature of 650° C. or lower.

After finish rolling has been performed, by performing rapid cooling to a temperature range in which bainite transformation occurs without allowing ferrite transformation to occur, the steel sheet microstructure of a hot-rolled steel sheet is controlled. There is an effect of decreasing the crystal grain diameter of a final steel sheet microstructure, in particular, ferrite and martensite through the above-mentioned control of a steel sheet microstructure which is intended for the homogenization of material properties. Therefore, cooling is started within 1 second after finish rolling has been performed and performed to a first cooling stop temperature of 650° C. or lower at a first average cooling rate of 80° C./s or more.

In the case where the first cooling rate is lower than 80° C./s, since ferrite transformation starts, an inhomogeneous steel sheet microstructure is formed in the hot-rolled steel sheet, which results in a decrease in hole expansion capability after annealing has been performed. In addition, in the case where the first cooling stop temperature is higher than 650° C., since an excessive amount of pearlite is formed, an inhomogeneous steel sheet microstructure is formed in the hot-rolled steel sheet, which results in a decrease in hole expansion capability after annealing has been performed. Therefore, the first cooling operation following finish rolling is performed to a temperature of 650° C. or lower at a first average cooling rate of 80° C./s or more.

The second cooling operation following the first cooling operation is a cooling operation in which cooling is performed under the conditions of a second average cooling rate of 5° C./s or more and a second cooling stop temperature of lower than the first cooling stop temperature and 550° C. or lower.

In the case where cooling is performed under the condition of a second average cooling rate of less than 5° C./s or a second cooling stop temperature of higher than 550° C., since an excessive amount of ferrite or pearlite is formed in the steel sheet microstructure of the hot-rolled steel sheet, there is a decrease in hole expansion capability after annealing has been performed. Therefore, the second average cooling rate is set to be 5° C./s or more, and the second cooling stop temperature is set to be lower than the first cooling stop temperature and 550° C. or lower.

It is preferable that the coiling temperature, at which coiling is performed after the second cooling operation, be 550° C. or lower. In the case where the coiling temperature is higher than 550° C., there is a case where excessive amounts of ferrite and pearlite are formed. Therefore, it is preferable that the upper limit of the coiling temperature be 550° C., or more preferably 500° C. or lower. Although there is no particular limitation on the lower limit of the coiling temperature, in the case where the coiling temperature is excessively low, there is a case where, since an excessive amount of hard martensite is formed, there is an increase in cold rolling load. Therefore, it is preferable that the lower limit of the coiling temperature be 300° C.

Pickling Process

It is preferable that a pickling process be performed after the hot rolling process in order to remove scale from the surface layer of the hot-rolled steel sheet. There is no particular limitation on the conditions used for the pickling process, and the pickling process may be performed by using a commonly used method.

Cold Rolling Process

The cold rolling process is a process in which cold rolling is performed on the hot-rolled steel sheet after the hot rolling process (or after the pickling process in the case where the pickling process is performed). There is no particular limitation on the conditions used for the cold rolling process, and the cold rolling process may be performed by using a commonly used method.

Annealing Process

The annealing process is performed in order to promote recrystallization and to form bainite, tempered martensite, retained austenite, and martensite in a steel sheet microstructure for the purpose of increasing strength. Therefore, the annealing process is composed of a first heating operation, a second heating operation, a third heating operation, a first soaking operation, a third cooling operation, a fourth heating operation, a second soaking operation, and a fourth cooling operation. Specific description is as follows.

The first heating operation is performed at an arbitrary first average heating rate under the condition of a first heating end-point temperature of 250° C. to 350° C. Specifically, the cold-rolled steel sheet at room temperature is heated to a temperature of 250° C. to 350° C. at an arbitrary first average heating rate. The first heating operation is an operation in which heating is performed to a temperature of 250° C. to 350° C., that is, the temperature at which recrystallization due to annealing is started, and may be performed by using a commonly used method. Although the first average heating rate may be arbitrarily decided as described above, and although there is no particular limitation on the first average heating rate, it is usually 0.5° C./s to 50° C./s.

The second heating operation is performed after the first heating operation described above under the conditions of a second average heating rate of 6° C./s to 25° C./s and a second heating end-point temperature of 550° C. to 680° C. The second heating operation relates to a specification which contributes to an decrease in crystal grain diameter, which is important in the disclosed embodiments, and it is possible to decrease crystal grain diameter after annealing is performed by controlling the generation rate of ferrite nucleation sites, which are formed through recrystallization occurring until the steel sheet temperature reaches a dual-phase temperature range, to be larger than the growth rate of the generated grains, that is, the rate at which the grain diameter increases. In the case where heating is rapidly performed, since recrystallization is less likely to progress, non-recrystallized grains are retained in the final steel sheet microstructure, which results in a decrease in ductility. Therefore, the upper limit of the second average heating rate is set to be 25° C./s. In addition, in the case where the heating rate is excessively small, there is an increase in the crystal grain diameter of a ferrite phase, it is not possible to achieve the specified average crystal grain diameter. It is necessary that the second average heating rate be 6° C./s or more, or preferably 8° C./s or more.

The third heating operation is performed after the second heating operation under the conditions of a third average heating rate of 10° C./s or less and a third heating end-point temperature of 760° C. to 850° C. Fine ferrite is formed until the steel sheet temperature reaches the second heating end-point temperature. When the steel sheet temperature reaches a temperature equal to or higher than the Ac1 transformation temperature, which is in a dual-phase temperature range, austenite nucleation starts. In order to completely finish recrystallization, the third average heating rate from the second heating end-point temperature to the third heating end-point temperature is set to be 10° C./s or less. In the case where the third average heating rate is more than 10° C./s, since austenite nucleation occurs more readily than recrystallization, non-recrystallized grains are retained in the final steel sheet microstructure, which results in insufficient ductility. Therefore, the upper limit of the third average heating rate is set to be 10° C./s. Although there is no particular limitation on the lower limit, in the case where the third average heating rate is less than 0.5° C./s, there is a risk of an excessive increase in the crystal grain diameter of a ferrite phase. Therefore, it is preferable that the third average heating rate be 0.5° C./s or more. Here, the third heating end-point temperature is usually set to be equal to the first soaking temperature described below.

The first soaking operation is performed after the third heating operation under the conditions of a first soaking temperature of 760° C. to 850° C. and a first soaking time of 30 seconds or more. The first soaking temperature is set to be in a dual-phase temperature range in which ferrite and austenite are formed. In the case where the first soaking temperature is lower than 760° C., since there is an increase in ferrite volume fraction, it is difficult to achieve sufficient strength and hole expansion capability at the same time. Therefore, the first soaking temperature is set to be 760° C. or higher. In the case where the first soaking temperature is excessively high, since annealing is performed in temperature range in which an austenite single phase is formed, there is a decrease in delayed fracturing resistance. Therefore, the first soaking temperature is set to be 850° C. or lower. In addition, in order to allow recrystallization to progress and to allow austenite transformation to occur partially or completely at the first soaking temperature described above, it is necessary that the first soaking time be 30 seconds or more. Although there is no particular limitation on the upper limit of the first soaking time, it is preferable that the first soaking time be 600 seconds or less.

The third cooling operation is performed after the first soaking operation under the conditions of a third average cooling rate of 3° C./s or more and a third cooling stop temperature of 100° C. to 300° C. In order to form tempered martensite from the viewpoint of high yield ratio and sufficient hole expansion capability, and in order to allow the martensite transformation of a part of austenite, which has been formed in a soaking zone, to occur by performing cooling from the first soaking temperature to a temperature equal to or lower than the temperature at which martensite transformation starts, cooling is performed to a third cooling stop temperature of 100° C. to 300° C. at a third average cooling rate of 3° C./s or more. In the case where the third average cooling rate is less than 3° C./s, excessive amounts of pearlite and spheroidal cementite are formed in the steel sheet microstructure. Therefore, the lower limit of the third average cooling rate is set to be 3° C./s or more. In addition, in the case where the third cooling stop temperature is lower than 100° C., since an excessive amount of martensite is formed when cooling is performed, there is a decrease in the amounts of bainite transformation and retained austenite due to a decrease in the amount of untransformed austenite, which results in a decrease in elongation. In the case where the third cooling stop temperature is higher than 300° C., since there is a decrease in the amount of tempered martensite, there is a decrease in hole expansion capability. Therefore, the third cooling stop temperature is set to be 100° C. to 300° C., or preferably 150° C. to 280° C.

The fourth heating operation is performed after the third cooling operation under the condition of a fourth heating end-point temperature of 350° C. to 450° C. The fourth heating operation is performed in order to perform heating to the second soaking temperature.

The second soaking operation is performed after the fourth heating operation under the conditions of a second soaking temperature of 350° C. to 450° C. and a second soaking time of 30 seconds or more. The second soaking operation is performed in order to form tempered martensite by tempering martensite which has been formed in the middle of the cooling operation and in order to form bainite and retained austenite in the steel sheet microstructure by allow the bainite transformation of untransformed austenite to occur. In the case where the second soaking temperature is lower than 350° C., since martensite is tempered insufficiently, there is an increase in the difference in hardness between ferrite and martensite, which results in a decrease in hole expansion capability. In addition, in the case where the second soaking temperature is higher than 450° C., since an excessive amount of pearlite is formed, there is a decrease in elongation. Therefore, the second soaking temperature is set to be 350° C. to 450° C. In addition, in the case where the second soaking time is less than 30 seconds, since bainite transformation does not sufficiently progress, an excessive amount of martensite is finally formed due to an increase in the amount of untransformed austenite, which results in a decrease in hole expansion capability. Therefore, the second soaking time is set to be 30 seconds or more. In addition, it is preferable that the second soaking time be 3600 seconds or less in order to achieve sufficient volume fraction of martensite.

The fourth cooling operation is performed after the second soaking operation under the condition of a fourth cooling stop temperature of 0° C. to 50° C. The fourth cooling operation may be performed by using a method, in which cooling is not actively performed, such as an air cooling method, in which the steel sheet is left and allowed to cool in the air.

Skin Pass Rolling Process

Skin pass rolling may be performed after the annealing process. It is preferable that the elongation ratio of skin pass rolling be 0.1% to 2.0%.

Here, as long as it is within the range according to the disclosed embodiments, the cold-rolled steel sheet may be made into a galvanized steel sheet by performing a galvanizing treatment in the annealing process, and the galvanized steel sheet may be made into a galvannealed steel sheet by performing an alloying treatment. Moreover, the cold-rolled steel sheet may be made into an electroplated steel sheet by performing an electroplating treatment. The examples of the high-strength cold-rolled steel sheet according to the disclosed embodiments include such coated steel sheets.

Examples

The examples of the disclosed embodiments will be described hereafter.

By preparing molten steels having the chemical compositions given in Table 1, by casting the molten steels in to slabs, and by performing hot rolling with the hot rolling start temperature of 1250° C. and the finishing delivery temperatures (FDT in Table 2), hot-rolled steel sheets having a thickness of 3.2 mm were obtained. Within 1 second after hot rolling had been performed as described above, by performing cooling to the first cooling stop temperature (CST1 in Table 2) at the first average cooling rates given in Table 2 (CR1 in Table 2), and by then performing cooling to the coiling temperatures (CT in Table 2) at the second average cooling rates (CR2 in Table 2) (the coiling temperature corresponded to the second cooling stop temperature), the hot-rolled steel sheets were coiled at the coiling temperatures. Subsequently, by pickling the obtained hot-rolled steel sheets, and by then performing cold rolling, cold-rolled steel sheets (having a thickness of 1.4 mm) were manufactured. Subsequently, the first heating operation was performed under the conditions of a first average heating rate of 640° C./s and a first heating end-point temperature of 300° C. Subsequently, heating was performed to a temperature of 680° C. (second heating end-point temperature) at the second average heating rates given in Table 2 (C2 in Table 2). subsequently, heating was performed to the first soaking temperatures (also called third heating end-point temperatures) at the third average heating rates (C3 in Table 2), and the first soaking operation was performed with the first soaking temperatures (ST1 in Table 2) and the first soaking times (HT1 in Table 2) given in Table 2. Subsequently, cooling was performed to the third cooling stop temperatures (Ta in Table 2) at the third average cooling rates (CR3 in Table 2), the fourth heating operation was then performed to the second soaking temperatures given in Table 2 (Tb in Table 2), the second soaking operation was performed with the second soaking temperatures and the second soaking times (HT2 in Table 2) given in Table 2, and cooling was finally performed to room temperature (0° C. to 50° C.)

A tensile test (JIS Z 2241 (1998)) was performed on a JIS No. 5 tensile test piece which had been taken from the manufactured steel sheet so that the longitudinal direction (tensile direction) of the test piece was a direction at a right angle to the rolling direction in order to determine yield strength (YS), tensile strength (TS), total elongation (EL), and yield ratio (YR).

Regarding stretch flange formability, hole expansion ratio (λ) was determined in accordance with The Japan Iron and Steel Federation Standard (JFST 1001 (1996)), by punching a hole having a diameter of 10 mmϕ with a clearance of 12.5% of the thickness, by setting the test piece on the testing machine so that the burr was on the die side, and by forming the test piece by using a conical punch having a tip angle of 60°. A case where λ (%) was 40% or more was judged as a case of a steel sheet having a satisfactory stretch flange formability.

Regarding delayed fracturing resistance test, by taking a test piece of 30 mm×100 mm from the obtained steel sheet so that the longitudinal direction of the test piece was the rolling direction, by grinding the end surfaces of the test piece, and by using a punch having a tip curvature radius of 10 mm, bending work at an angle of 180° was performed on the test piece. By bolting the test piece which had been subjected to bending work against spring back which occurred in the test piece so that the inner distance was 20 mm in order to apply stress to the test piece, and by then immersing the test piece in hydrochloric acid having a temperature of 20° C. and a pH of 1, time until fracturing occurred was determined within 100 hours. A case where a crack did not occur in the test piece within 100 hours was judged as "Good", and a case where a crack occurred in the test piece was judged as "Poor".

The volume fraction of each of ferrite and martensite of the steel sheet was defined as an area ratio which was determined by polishing a cross section in the thickness direction parallel to the rolling direction of the steel sheet, by etching the polished cross section by using a 3%-nital solution, by observing the etched cross section by using a SEM (scanning electron microscope) at magnifications of 2000 times and 5000 times, and by using a point count method (in accordance with ASTM E562-83 (1988)). The average crystal grain diameter (average grain diameter in the table) of each of ferrite and martensite was derived by calculating the average value of the circle-equivalent diameters of the areas of the grains of each of ferrite and martensite which were calculated by using Image-Pro manufactured by Media Cybernetics, Inc. from the photograph of the steel sheet microstructure in which grains of each of ferrite and martensite were distinguished from other phases.

The volume fraction of retained austenite was derived from the X-ray diffraction intensity in the surface located at ¼ of the thickness of the steel sheet determined by polishing the steel sheet to the surface located at ¼ of the thickness. The volume fraction of retained austenite was derived by using the Kα-ray of Mo as a radiation source with an accelerating voltage of 50 keV, by determining the integrated intensities of X-ray diffraction of the {200} plane, {211} plane, and {220} plane of the ferrite of iron and the {200} plane, {220} plane, and {311} plane of the austenite of iron with an X-ray diffraction method (apparatus: RINT-2200 produced by Rigaku Corporation), and by using the calculating formula described in "X-ray Diffraction Handbook" (2000) published by Rigaku Corporation, pp. 26 and 62-64.

In addition, the kinds of steel sheet microstructures other than ferrite, retained austenite, and martensite were identified by observing the steel sheet microstructure with a SEM (scanning electron microscope), a TEM (transmission electron microscope), and an FE-SEM (field-emission-type scanning electron microscope). The average crystal grain diameter of the microstructure composed of bainite and/or tempered martensite was derived by calculating the average value of the circle-equivalent diameters which were calculated by using Image-Pro described above from the photograph of the steel sheet microstructure.

The determined results of tensile properties, hole expansion ratio, delayed fracturing resistance, and steel sheet microstructure are given in Table 3 (Table 3-1 and Table 3-2 are combined to form Table 3).

From the results given in Table 3, it is clarified that all of the examples of the disclosed embodiments had a microstructure including ferrite having an average crystal grain diameter of less than 2 μm in an amount of 10% to 25% in terms of volume fraction, retained austenite in an amount of 5% to 20% in terms of volume fraction, martensite having an average crystal grain diameter of 2 μm or less in an amount of 5% to 15% in terms of volume fraction, and the balance being a multi-phase structure including bainite and tempered martensite having an average crystal grain diameter of 5 μm or less, and, as a result, had not only a tensile strength of 1180 MPa or more and a yield ratio of 70% or more but also satisfactory workability represented by an elongation of 17.5% or more and a hole expansion ratio of 40% or more and excellent delayed fracturing resistance represented by the fact that fracturing did not occur for 100 hours in the delayed fracturing resistance test. On the other hand, the comparative examples, as a result of their steel sheet microstructures being out of the range according to the disclosed embodiments, were poor in terms of at least one of tensile strength, yield ratio, elongation, hole expansion ratio, and delayed fracturing resistance.

TABLE 1

| Steel | Chemical Composition (mass %) | | | | | | | | | | |
|---|---|---|---|---|---|---|---|---|---|---|---|
| Grade | C | Si | Mn | P | S | Al | N | Ti | B | Other | Note |
| A | 0.20 | 1.66 | 2.49 | 0.01 | 0.002 | 0.03 | 0.002 | 0.011 | 0.0014 | — | Example Steel |
| B | 0.18 | 1.51 | 2.81 | 0.01 | 0.001 | 0.02 | 0.002 | 0.013 | 0.0017 | — | Example Steel |
| C | 0.16 | 1.39 | 3.10 | 0.01 | 0.001 | 0.03 | 0.002 | 0.012 | 0.0033 | V: 0.02 | Example Steel |
| D | 0.17 | 1.96 | 2.47 | 0.01 | 0.002 | 0.02 | 0.002 | 0.013 | 0.0019 | Nb: 0.03 | Example Steel |
| E | 0.20 | 1.40 | 2.49 | 0.02 | 0.001 | 0.03 | 0.003 | 0.019 | 0.0014 | Cr: 0.18 | Example Steel |
| F | 0.22 | 1.33 | 2.24 | 0.01 | 0.001 | 0.03 | 0.001 | 0.031 | 0.0022 | Mo: 0.15 | Example Steel |
| G | 0.16 | 2.11 | 2.33 | 0.02 | 0.003 | 0.04 | 0.003 | 0.014 | 0.0015 | Cu: 0.18 | Example Steel |
| H | 0.19 | 1.18 | 2.74 | 0.01 | 0.002 | 0.03 | 0.001 | 0.013 | 0.0031 | Ni: 0.22 | Example Steel |
| I | 0.21 | 1.34 | 2.88 | 0.02 | 0.002 | 0.04 | 0.003 | 0.028 | 0.0019 | Ca: 0.0028 | Example Steel |
| J | 0.16 | 1.42 | 2.81 | 0.01 | 0.001 | 0.03 | 0.002 | 0.014 | 0.0033 | REM: 0.0028 | Example Steel |
| K | 0.12 | 1.66 | 2.94 | 0.01 | 0.002 | 0.03 | 0.002 | 0.015 | 0.0015 | — | Comparative Example |
| L | 0.21 | 0.59 | 3.01 | 0.01 | 0.002 | 0.03 | 0.003 | 0.018 | 0.0022 | — | Comparative Example |
| M | 0.18 | 2.02 | 1.76 | 0.01 | 0.002 | 0.03 | 0.003 | 0.022 | 0.0031 | — | Comparative Example |
| N | 0.18 | 0.88 | 3.67 | 0.02 | 0.002 | 0.04 | 0.003 | 0.019 | 0.0019 | — | Comparative Example |
| O | 0.21 | 1.46 | 3.22 | 0.02 | 0.002 | 0.03 | 0.003 | 0.015 | — | — | Comparative Example |

Under-lined portion: out of the range according to the disclosed embodiments

TABLE 2

| | | Hot Rolling Process | | | | | Annealing Process | | | | | | | |
|---|---|---|---|---|---|---|---|---|---|---|---|---|---|---|
| Sample Number | Steel Grade | FDT ° C. | CR1 ° C./s | CST1 ° C. | CR2 ° C./s | CT ° C. | C2 ° C./s | C3 ° C./s | ST1 ° C. | HT1 sec | CR3 ° C./s | Ta ° C. | Tb ° C. | HT2 sec |
| 1 | A | 900 | 100 | 590 | 25 | 500 | 10 | 2 | 800 | 300 | 5 | 200 | 400 | 600 |
| 2 | A | 900 | 120 | 540 | 25 | 470 | 12 | 2 | 810 | 300 | 7 | 250 | 400 | 300 |
| 3 | B | 900 | 100 | 600 | 25 | 500 | 8 | 3 | 810 | 250 | 4 | 210 | 400 | 500 |
| 4 | B | 900 | 100 | 600 | 22 | 450 | 8 | 5 | 820 | 300 | 6 | 200 | 420 | 600 |
| 5 | C | 900 | 100 | 600 | 22 | 550 | 6 | 3 | 800 | 300 | 5 | 240 | 400 | 600 |

TABLE 2-continued

| | | Hot Rolling Process | | | | | Annealing Process | | | | | | | |
|---|---|---|---|---|---|---|---|---|---|---|---|---|---|---|
| Sample Number | Steel Grade | FDT ° C. | CR1 ° C./s | CST1 ° C. | CR2 ° C./s | CT ° C. | C2 ° C./s | C3 ° C./s | ST1 ° C. | HT1 sec | CR3 ° C./s | Ta ° C. | Tb ° C. | HT2 sec |
| 6 | D | 900 | 100 | 610 | 20 | 500 | 10 | 5 | 820 | 300 | 10 | 180 | 380 | 600 |
| 7 | E | 900 | 100 | 580 | 30 | 500 | 15 | 4 | 810 | 600 | 11 | 240 | 400 | 300 |
| 8 | F | 900 | 100 | 600 | 20 | 500 | 15 | 1 | 800 | 300 | 7 | 250 | 400 | 600 |
| 9 | G | 900 | 100 | 580 | 20 | 540 | 15 | 2 | 780 | 300 | 6 | 200 | 380 | 600 |
| 10 | H | 900 | 100 | 580 | 45 | 520 | 8 | 2 | 810 | 350 | 6 | 220 | 400 | 180 |
| 11 | I | 900 | 90 | 600 | 20 | 500 | 20 | 2 | 840 | 500 | 5 | 200 | 420 | 300 |
| 12 | J | 900 | 120 | 600 | 15 | 500 | 8 | 4 | 800 | 300 | 12 | 160 | 400 | 500 |
| 13 | A | 900 | 50 | 600 | 20 | 470 | 10 | 3 | 820 | 300 | 8 | 240 | 380 | 600 |
| 14 | A | 900 | 90 | 750 | 30 | 500 | 10 | 3 | 800 | 300 | 6 | 200 | 420 | 600 |
| 15 | A | 900 | 100 | 600 | 2 | 470 | 10 | 5 | 820 | 300 | 7 | 200 | 400 | 600 |
| 16 | A | 900 | 100 | 600 | 25 | 650 | 10 | 5 | 800 | 300 | 6 | 200 | 400 | 600 |
| 17 | A | 900 | 100 | 600 | 20 | 500 | 1 | 5 | 820 | 300 | 6 | 250 | 400 | 600 |
| 18 | A | 900 | 100 | 580 | 20 | 540 | 50 | 3 | 800 | 300 | 5 | 200 | 400 | 550 |
| 19 | A | 900 | 100 | 600 | 15 | 500 | 10 | 15 | 800 | 300 | 5 | 220 | 400 | 500 |
| 20 | A | 900 | 100 | 600 | 20 | 470 | 10 | 4 | 750 | 300 | 5 | 220 | 400 | 600 |
| 21 | A | 900 | 100 | 600 | 20 | 470 | 10 | 4 | 900 | 300 | 10 | 220 | 400 | 600 |
| 22 | A | 900 | 100 | 620 | 20 | 470 | 10 | 4 | 820 | 300 | 1 | 200 | 400 | 600 |
| 23 | A | 900 | 100 | 620 | 20 | 470 | 10 | 4 | 820 | 250 | 7 | 380 | 420 | 600 |
| 24 | A | 900 | 100 | 580 | 25 | 470 | 10 | 4 | 820 | 300 | 5 | 50 | 380 | 600 |
| 25 | A | 900 | 120 | 580 | 20 | 500 | 10 | 3 | 820 | 300 | 5 | 200 | 550 | 600 |
| 26 | A | 900 | 100 | 600 | 20 | 450 | 10 | 2 | 820 | 300 | 5 | 200 | 250 | 500 |
| 27 | A | 900 | 100 | 580 | 20 | 470 | 5 | 2 | 820 | 250 | 8 | 220 | 400 | 10 |
| 28 | K | 900 | 100 | 600 | 20 | 450 | 10 | 2 | 780 | 300 | 6 | 200 | 420 | 300 |
| 29 | L | 900 | 110 | 580 | 30 | 500 | 10 | 2 | 820 | 300 | 5 | 200 | 420 | 500 |
| 30 | M | 900 | 100 | 600 | 20 | 450 | 10 | 2 | 820 | 300 | 5 | 200 | 420 | 500 |
| 31 | N | 900 | 100 | 600 | 25 | 500 | 5 | 3 | 820 | 300 | 5 | 200 | 420 | 500 |
| 32 | O | 900 | 100 | 600 | 20 | 470 | 10 | 3 | 820 | 250 | 5 | 200 | 420 | 600 |

Under-lined portion: out of the ranges of manufacturing conditions according to the method of the disclosed embodiments

TABLE 3-1

| | Microstructure | | | | | | | | | | |
|---|---|---|---|---|---|---|---|---|---|---|---|
| | Ferrite | | | Martensite | | Remainder | | | | | |
| Sample Number | Volume Fraction/ % | Average Grain Diameter/ μm | Retained Austenite Volume Fraction/% | Volume Fraction/% | Average Grain Diameter/ μm | Kind | Average Grain Diameter/ μm | V1 % | V2 % | V2/V1 | Note |
| 1 | 11 | 2 | 12 | 8 | 1 | B, TM | 4 | 89 | 60 | 0.67 | Example |
| 2 | 13 | 2 | 9 | 7 | 2 | B, TM | 3 | 87 | 52 | 0.60 | Example |
| 3 | 12 | 1 | 11 | 7 | 2 | B, TM | 4 | 88 | 48 | 0.54 | Example |
| 4 | 13 | 2 | 10 | 8 | 1 | B, TM | 4 | 87 | 48 | 0.55 | Example |
| 5 | 11 | 2 | 8 | 7 | 2 | B, TM | 2 | 89 | 61 | 0.69 | Example |
| 6 | 14 | 2 | 8 | 7 | 2 | B, TM | 3 | 86 | 44 | 0.51 | Example |
| 7 | 12 | 1 | 10 | 10 | 1 | B, TM | 3 | 88 | 56 | 0.64 | Example |
| 8 | 13 | 1 | 11 | 8 | 2 | B, TM | 2 | 87 | 56 | 0.64 | Example |
| 9 | 17 | 1 | 9 | 10 | 1 | B, TM | 2 | 83 | 58 | 0.70 | Example |
| 10 | 11 | 2 | 9 | 7 | 1 | B, TM | 3 | 89 | 54 | 0.61 | Example |
| 11 | 12 | 2 | 8 | 7 | 2 | B, TM | 4 | 88 | 48 | 0.55 | Example |
| 12 | 14 | 2 | 10 | 7 | 2 | B, TM | 3 | 86 | 57 | 0.66 | Example |
| 13 | 12 | 2 | 8 | 8 | 2 | B, TM | 7 | 88 | 60 | 0.68 | Comparative Example |
| 14 | 12 | 3 | 8 | 7 | 4 | B, TM | 5 | 88 | 48 | 0.54 | Comparative Example |
| 15 | 10 | 4 | 7 | 8 | 1 | B, TM | 5 | 90 | 59 | 0.65 | Comparative Example |
| 16 | 11 | 3 | 11 | 7 | 3 | B, TM | 4 | 89 | 53 | 0.59 | Comparative Example |
| 17 | 11 | 3 | 9 | 6 | 4 | B, TM | 6 | 89 | 61 | 0.69 | Comparative Example |
| 18 | 16 | 3 | 6 | 10 | 3 | B, TM, UF | 4 | 84 | 54 | 0.64 | Comparative Example |
| 19 | 12 | 4 | 6 | 8 | 3 | B, TM, UF | 4 | 88 | 43 | 0.49 | Comparative Example |
| 20 | 21 | 4 | 8 | 3 | 2 | B, TM | 5 | 79 | 51 | 0.64 | Comparative Example |
| 21 | 5 | 2 | 6 | 11 | 5 | B, TM | 7 | 95 | 59 | 0.62 | Comparative Example |
| 22 | 19 | 4 | 9 | 7 | 2 | B, TM, P | 4 | 81 | 48 | 0.59 | Comparative Example |

TABLE 3-1-continued

| | Microstructure | | | | | | | | | | |
|---|---|---|---|---|---|---|---|---|---|---|---|
| | Ferrite | | | Martensite | | Remainder | | | | | |
| Sample Number | Volume Fraction/ % | Average Grain Diameter/ μm | Retained Austenite Volume Fraction/% | Volume Fraction/% | Average Grain Diameter/ μm | Kind | Average Grain Diameter/ μm | V1 % | V2 % | V2/V1 | Note |
| 23 | 10 | 2 | 11 | 18 | 6 | B, TM | 4 | 90 | 29 | 0.32 | Comparative Example |
| 24 | 12 | 2 | 4 | 5 | 1 | B, TM | 5 | 88 | 71 | 0.81 | Comparative Example |
| 25 | 11 | 2 | 4 | 6 | 2 | B, TM, P | 4 | 89 | 57 | 0.64 | Comparative Example |
| 26 | 12 | 1 | 12 | 16 | 3 | B, TM | 3 | 88 | 34 | 0.39 | Comparative Example |
| 27 | 11 | 2 | 10 | 17 | 3 | B, TM | 4 | 89 | 57 | 0.64 | Comparative Example |
| 28 | 26 | 5 | 6 | 6 | 2 | B, TM | 4 | 74 | 50 | 0.68 | Comparative Example |
| 29 | 5 | 1 | 7 | 9 | 2 | B, TM | 3 | 95 | 60 | 0.63 | Comparative Example |
| 30 | 15 | 3 | 6 | 5 | 3 | B, TM | 4 | 85 | 46 | 0.54 | Comparative Example |
| 31 | 8 | 2 | 9 | 13 | 3 | B, TM | 4 | 92 | 59 | 0.64 | Comparative Example |
| 32 | 4 | 2 | 12 | 8 | 3 | B, TM | 4 | 96 | 47 | 0.49 | Comparative Example |

Under-lined portion: out of the range according to the disclosed embodiments or below the evaluation standard
Remainder:
B—bainite,
TM—Tempered martensite,
P—pearlite,
UF—un-recrystallized ferrite

TABLE 3-2

| | Tensile Property | | | | Hole Expansion Ratio | Delayed | |
|---|---|---|---|---|---|---|---|
| Sample Number | YS MPa | TS MPa | EL % | YR % | λ % | Fracturing Resistance | Note |
| 1 | 1019 | 1221 | 19.0 | 83 | 45 | Good | Example |
| 2 | 964 | 1239 | 21.1 | 78 | 43 | Good | Example |
| 3 | 1032 | 1233 | 18.9 | 84 | 49 | Good | Example |
| 4 | 988 | 1219 | 19.3 | 81 | 42 | Good | Example |
| 5 | 1052 | 1230 | 18.8 | 86 | 45 | Good | Example |
| 6 | 981 | 1233 | 18.3 | 80 | 41 | Good | Example |
| 7 | 965 | 1255 | 18.3 | 77 | 42 | Good | Example |
| 8 | 959 | 1244 | 18.1 | 77 | 40 | Good | Example |
| 9 | 898 | 1228 | 19.1 | 73 | 40 | Good | Example |
| 10 | 1001 | 1284 | 18.1 | 78 | 43 | Good | Example |
| 11 | 1011 | 1205 | 18.0 | 84 | 42 | Good | Example |
| 12 | 977 | 1190 | 18.1 | 82 | 43 | Good | Example |
| 13 | 945 | 1215 | 17.7 | 78 | 31 | Good | Comparative Example |
| 14 | 976 | 1212 | 17.6 | 81 | 28 | Good | Comparative Example |
| 15 | 899 | 1188 | 17.9 | 76 | 33 | Good | Comparative Example |
| 16 | 943 | 1234 | 17.6 | 76 | 34 | Good | Comparative Example |
| 17 | 944 | 1211 | 17.8 | 78 | 28 | Good | Comparative Example |
| 18 | 1123 | 1194 | 14.8 | 94 | 21 | Poor | Comparative Example |
| 19 | 1121 | 1234 | 14.3 | 91 | 17 | Poor | Comparative Example |
| 20 | 912 | 1149 | 17.5 | 79 | 12 | Good | Comparative Example |
| 21 | 791 | 1211 | 17.4 | 65 | 10 | Good | Comparative Example |
| 22 | 949 | 1176 | 17.8 | 81 | 18 | Good | Comparative Example |
| 23 | 774 | 1239 | 17.6 | 62 | 12 | Poor | Comparative Example |
| 24 | 1105 | 1222 | 14.1 | 90 | 63 | Good | Comparative Example |
| 25 | 978 | 1233 | 15.5 | 79 | 27 | Good | Comparative Example |
| 26 | 824 | 1189 | 17.3 | 69 | 22 | Poor | Comparative Example |
| 27 | 833 | 1215 | 17.1 | 69 | 12 | Poor | Comparative Example |
| 28 | 899 | 1129 | 17.4 | 80 | 25 | Good | Comparative Example |
| 29 | 894 | 1211 | 16.5 | 74 | 44 | Good | Comparative Example |

TABLE 3-2-continued

| Sample Number | Tensile Property YS MPa | TS MPa | EL % | YR % | Hole Expansion Ratio λ % | Delayed Fracturing Resistance | Note |
|---|---|---|---|---|---|---|---|
| 30 | 881 | 1128 | 17.5 | 78 | 22 | Good | Comparative Example |
| 31 | 977 | 1225 | 17.0 | 80 | 35 | Poor | Comparative Example |
| 32 | 889 | 1225 | 16.8 | 73 | 38 | Poor | Comparative Example |

Under-lined portion: out of the range according to the disclosed embodiments or below the evaluation standard
Remainder:
B—bainite,
TM—Tempered martensite,
P—pearlite,
UF—un-recrystallized ferrite

The invention claimed is:

1. A high-strength cold-rolled steel sheet having a chemical composition comprising, by mass %:

C: 0.15% to 0.25%;
Si: 1.2% to 2.5%;
Mn: 2.1% to 3.5%;
P: 0.05% or less;
S: 0.005% or less;
Al: 0.01% to 0.08%;
N: 0.010% or less;
Ti: 0.002% to 0.050%;
B: 0.0002% to 0.0100%; and
the balance being Fe and inevitable impurities, wherein the cold-rolled steel sheet has a microstructure including (i) ferrite having an average crystal grain diameter of 2 μm or less in an amount in a range of 10% to 25% in terms of volume fraction, (ii) retained austenite in an amount in a range of 5% to 20% in terms of volume fraction, (iii) martensite having an average crystal grain diameter of 2 μm or less in an amount in a range of 5% to 15% in terms of volume fraction, and (iv) the balance being a multi-phase structure including bainite and tempered martensite, the bainite and tempered martensite having an average crystal grain diameter of 5 μm or less, the tempered martensite being present in the microstructure in an amount in a range of 20% to 60% in terms of volume fraction, the bainite being present in the microstructure in an amount in a range of 10% to 40% in terms of volume fraction, and relational expression (1) is satisfied:

$$0.35 \leq V2/V1 \leq 0.75 \quad (1)$$

where V1 is a volume fraction of phases which are different from ferrite and V2 is a volume fraction of tempered martensite.

2. The high-strength cold-rolled steel sheet according to claim 1, wherein the chemical composition further comprises, by mass %, at least one selected from the group consisting of V: 0.05% or less, and Nb: 0.05% or less.

3. The high-strength cold-rolled steel sheet according to claim 1, wherein the chemical composition further comprises, by mass %, at least one selected from the group consisting of Cr: 0.50% or less, Mo: 0.50% or less, Cu: 0.50% or less, Ni: 0.50% or less, Ca: 0.0050% or less, and REM: 0.0050% or less.

4. A method for manufacturing a high-strength cold-rolled steel sheet, the method comprising:

a hot rolling process in which a rolling operation is performed on a steel slab having a chemical composition comprising, by mass %, C: 0.15% to 0.25%, Si: 1.2% to 2.5%, Mn: 2.1% to 3.5%, P: 0.05% or less, S: 0.005% or less, Al: 0.01% to 0.08%, N: 0.010% or less, Ti: 0.002% to 0.050%, B: 0.0002% to 0.0100%, and the balance being Fe and inevitable impurities, at a temperature in a range of 1150° C. to 1300° C. under a condition of a finishing delivery temperature in a range of 850° C. to 950° C., in which (i) cooling is started within 1 second after the rolling operation, (ii) a first cooling operation is performed under conditions of a first average cooling rate of 80° C./s or more and a first cooling stop temperature of 650° C. or lower, (iii) a second cooling operation is performed after the first cooling operation under conditions of a second average cooling rate of 5° C./s or more and a second cooling stop temperature of lower than the first cooling stop temperature and 550° C. or lower, and (iv) a coiling operation is performed after the second cooling operation;

optionally, a pickling process in which a pickling operation is performed after the hot rolling process;

a cold rolling process in which a cold rolling operation is performed (i) after the hot rolling process and (ii) if the pickling process is performed, after the pickling process; and an annealing process in which a first heating operation is performed after the cold rolling process at an arbitrary first average heating rate under a condition of a first heating end-point temperature in a range of 250° C. to 350° C., in which (i) a second heating operation is performed after the first heating operation under conditions of a second average heating rate in a range of 6° C./s to 25° C./s and a second heating end-point temperature in a range of 550° C. to 680° C., (ii) a third heating operation is performed after the second heating operation under conditions of a third average heating rate of 10° C./s or less and a third heating end-point temperature in a range of 760° C. to 850° C., (iii) a first soaking operation is performed after the third heating operation under conditions of a first soaking temperature in a range of 760° C. to 850° C. and a first soaking time of 30 seconds or more, (iv) a third cooling operation is performed after the first soaking operation under conditions of a third average cooling rate of 3° C./s or more and a third cooling stop temperature in a range of 100° C. to 300° C., (v) a fourth heating operation is performed after the third cooling operation under a condition of a fourth heating end-point temperature in a range of 350° C. to 450° C., (vi) a second soaking operation is performed after the fourth heating operation under conditions of a second soaking temperature in a range of 350° C. to 450° C. and a second soaking time of 30 seconds or more, and (vii) a fourth cooling operation is performed after the second soaking operation under a condition of a fourth cooling stop temperature in a range of 0° C. to 50° C. thereby producing the high-strength cold-rolled steel sheet of claim 1.

5. The high-strength cold-rolled steel sheet according to claim 2, wherein the chemical composition further comprises, by mass %, at least one selected from the group consisting of Cr: 0.50% or less, Mo: 0.50% or less, Cu: 0.50% or less, Ni: 0.50% or less, Ca: 0.0050% or less, and REM: 0.0050% or less.

6. The method for manufacturing the high-strength cold-rolled steel sheet according to claim 4, wherein the chemical composition further comprises, by mass %, at least one selected from the group consisting of V: 0.05% or less, and Nb: 0.05% or less.

7. The method for manufacturing the high-strength cold-rolled steel sheet according to claim 4, wherein the chemical composition further comprises, by mass %, at least one selected from the group consisting of Cr: 0.50% or less, Mo: 0.50% or less, Cu: 0.50% or less, Ni: 0.50% or less, Ca: 0.0050% or less, and REM: 0.0050% or less.

8. The method for manufacturing the high-strength cold-rolled steel sheet according to claim 6, wherein the chemical composition further comprises, by mass %, at least one selected from the group consisting of Cr: 0.50% or less, Mo: 0.50% or less, Cu: 0.50% or less, Ni: 0.50% or less, Ca: 0.0050% or less, and REM: 0.0050% or less.

* * * * *